US008152155B1

(12) United States Patent
Jeong et al.

(10) Patent No.: US 8,152,155 B1
(45) Date of Patent: Apr. 10, 2012

(54) ENVELOPE FEED APPARATUS

(75) Inventors: Samuel Seok Jae Jeong, Sherwood, OR (US); Ian Joseph Frank, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/041,719

(22) Filed: Mar. 7, 2011

(51) Int. Cl.
*B65H 5/00* (2006.01)
*B65H 1/00* (2006.01)

(52) U.S. Cl. ..... 271/2; 271/145; 271/147; 271/162; 271/167

(58) Field of Classification Search ..... 271/145, 271/147, 160, 162, 167, 2; 221/47, 52, 65
See application file for complete search history.

(56) References Cited

U.S. PATENT DOCUMENTS

| | | | | |
|---|---|---|---|---|
| 813,594 | A * | 2/1906 | Sexton | 221/52 |
| 2,082,765 | A * | 6/1937 | Krueger | 221/45 |
| 3,902,712 | A | 9/1975 | Dorer | |
| 4,573,675 | A | 3/1986 | Svyatsky et al. | |
| 4,671,504 | A | 6/1987 | Lapinski et al. | |
| 5,927,705 | A | 7/1999 | Becker et al. | |
| 5,967,504 | A | 10/1999 | Yankloski | |

FOREIGN PATENT DOCUMENTS

| | | |
|---|---|---|
| JP | 5306028 | 11/1993 |

* cited by examiner

*Primary Examiner* — David H Bollinger
(74) *Attorney, Agent, or Firm* — Gibb I.P. Law Firm, LLC

(57) ABSTRACT

An envelope feed apparatus comprises a main body having a bottom; top (located opposite the bottom); and sides (located between the bottom and the top). The main body top has a flat surface that supports, for example, a stack of envelopes. The envelope feed apparatus also has a slider that includes sides contacting at least two of the main body sides. The slider sides move in a parallel direction to the main body sides as the slider moves relative to the main body. The slider has at least one roller connected to opposing slider sides. The roller(s) are positioned adjacent the main body top. The roller(s) move in a perpendicular direction to the flat surface of the main body top as the slider moves relative to the main body. The roller(s) contact the stack of envelopes when the stack of envelopes is on the flat surface of the main body top and apply pressure to the stack of envelopes in the perpendicular direction toward the flat surface of the main body top. The slider sides align the stack of envelopes positioned on the flat surface of the main body top and the roller keeps the top of the stack of envelopes mostly parallel to the flat surface of the main body to aid in feeding the envelopes into intake feed rollers of a printer.

19 Claims, 5 Drawing Sheets

ENVELOPE FEED APPARATUS

BACKGROUND

Embodiments herein generally relate to devices that feed sheets of media, such as envelopes, and more particularly to a top feed envelope supply apparatus that keeps the top envelope or folded sheet of large sheet stacks flat by using cross-members and/or rollers.

Stacks of flat sheets of media generally remain fairly level within paper trays of printing devices; however, if the sheets within the paper tray are folded (such as folded into partially completed books, handouts, or envelopes) one side of the sheets may be thicker than the other side, causing the stack to tilt. This tilt increases as the height of the stack increases. When such folded sheets are drawn from the bottom of the stack, the tilt may not cause many issues; however, when such are drawn from the top of the stack, the tilt can prevent the feed rollers from properly contacting the folded sheets.

For example, some conventional top feed printing devices cannot handle more than 10 to 15 envelopes at one time. This is a significant productivity issue for customers that are heavy envelope users. These customers would benefit from greater envelope feeder capacity.

SUMMARY

The embodiments herein provide a low cost high capacity envelope feeder kit that levels the upper envelope stack surface by loading rollers, oriented laterally across the top of the stack in some implementations to compress the slack in the region of the flaps and urge the envelopes to take a horizontal position against the rollers so that the pick process is highly effective. The feeder kit is placed over an envelope stack such that the relationship to the top of the stack is maintained as envelopes are fed.

An exemplary envelope feed apparatus herein comprises a main body having a bottom; top (located opposite the bottom); and sides (located between the bottom and the top). The main body top has a flat surface that supports, for example, a stack of envelopes. The envelope feed apparatus also has a slider that includes sides contacting at least two of the main body sides.

The sides of the slider move in a parallel direction to the sides of the main body as the slider moves relative to the main body. The slider has at least one roller connected to opposing slider sides. The roller(s) are positioned adjacent the main body top. The roller(s) move in a perpendicular direction to the flat surface of the main body top as the slider moves relative to the main body. The roller(s) contact the stack of envelopes when the stack of envelopes is on the flat surface of the main body top and apply pressure to the stack of envelopes in the perpendicular direction toward the flat surface of the main body top. The slider sides align the stack of envelopes positioned on the flat surface of the main body top and the roller keeps the top of the stack of envelopes mostly parallel to the flat surface of the main body to aid in feeding the envelopes from the top of the stack of envelopes into intake feed rollers of a printer.

Another exemplary apparatus includes a platform and cover over the platform. The platform has a platform bottom, a platform top located opposite the platform bottom, and platform sides located between the platform bottom and the platform top. The platform top has a flat surface that supports sheets of media. The cover includes cover sides contacting at least two of the platform sides. The platform bottom can include connectors that connect to a media tray of a printing machine.

The cover is movable relative to the platform. The sides of the cover move in a parallel direction to the platform sides as the cover moves relative to the platform. The cover has one or more cross-members, that may include rollers, connected to opposing cover sides. The rollers/cross-members are parallel to one another and are positioned adjacent the platform top. One of the rollers is positioned adjacent a first distal end of the flat surface of the platform top and a second roller is positioned adjacent the middle of the platform top. The top sheet of media is removed from the platform top by the printing machine at a second proximate end (the middle of the platform top is located between the first end and the second end, and the second proximate end of the platform is next to (proximate to) the feed rollers of the printer).

The rollers move in a perpendicular direction to the flat surface of the platform top as the cover moves relative to the platform. The rollers contact and press down on the top sheet of the sheets of media when the sheets of media are on the flat surface of the platform top. The rollers apply pressure to the sheets of media in the perpendicular direction (toward the flat surface of the platform top) in order to reduce or eliminate any tilt that the stack of sheets of media may have. This pressure can be created by the weight of the cover or a biased connector (spring, elastic band, biased pistor, etc.) can be connected to the platform and to the cover. The biased connector can draw the rollers toward the platform top. Thus, the rollers rotate the top sheet of the sheets of media toward a position parallel to the flat surface of the platform top.

Further, the sides of the cover align the sheets of media to keep the stack of media straight. Additionally, a projection can extend from the distal end of the flat surface of the platform top, the projection further aligns the sheets of media positioned on the flat surface of the platform top to keep the stack of media sheets straight.

Guides can be used to keep the platform and cover aligned. Therefore, the platform sides can include platform side recesses and/or platform side projections (platform guides). Similarly, the cover sides can include cover side recesses and/or cover side projections (cover guides). The platform side recesses and/or platform side projections contact the cover side recesses and/or cover side projections in order to restrict movement of the cover to a single path within the parallel direction between the platform and cover sides.

Also, the sides of the cover have a shape to provide a sheet exit at the proximate end of the platform. The sheets of media pass through the sheet exit as the sheets are removed from the top of the stack of sheets of media by the printing machine.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, stacks of folded sheets such as envelope stacks become very sloped due to the offset flap thickness bias to one side. Short stacks are tolerated because the angle created is minimal, but this worsens as the stack grows in height because, with large stacks, the top is very non level, making sheet feeding very difficult and unreliable. For example, a typical stack of 100 envelopes has a side to side height difference of 41 mm (84 mm front to 43 mm back side). This height difference results in such a large angle that there is not enough surface contact area for the pick roller.

Figure 1:
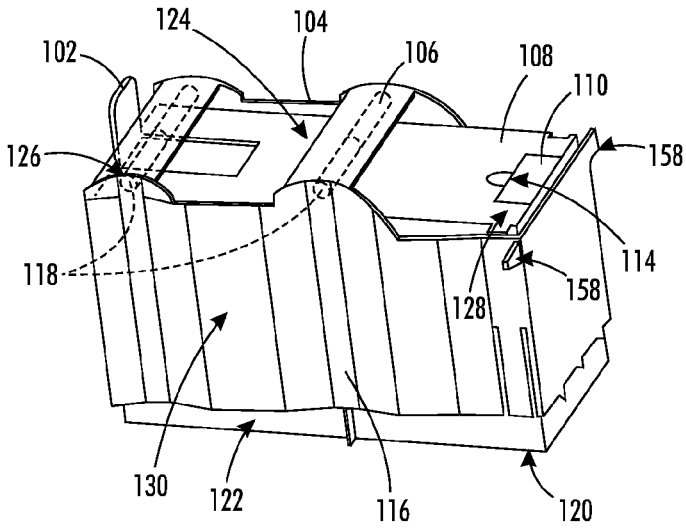
FIG. 1 is a perspective schematic diagram of a device according to embodiments herein.

As shown in FIG. 1, an exemplary embodiment includes a main body 108, a slider 104 that surrounds the sides the main body 108, longitudinal rollers 106 that are connected between the sides of the slider 104, and a retard pad 110. FIG. 1 also illustrates an empty media sensor hole 114, which a sensor (not shown) will see through when all of the media in the stack have been fed, and thus declare the stack empty. FIG. 1 also illustrates an optional retard pad 110 and a stopper 102.

While the main body 108 may have any shape that is appropriate for a given application, in the example shown in FIG. 1, it is illustrated as a rectangular box-shaped platform 108. However, as would be understood by those ordinarily skilled in the art, the platform 108 could have rounded features, could be circular, could be a cube-shape, or could be any other shape appropriate for a specific application. As illustrated, the platform 108 has a bottom 120, a top 124 (located opposite the bottom 120) and four sides 122 located between the platform bottom 120 and the platform top 124. The platform top 124 has a flat surface that supports sheets of media 154 (see FIG. 4).

Further, as shown in FIG. 1, the slider (which is often referred to herein as a "cover" 104 because it covers a portion of the platform 108) has dimensions that allow the cover 104 to fit over the platform 108. The cover 104 is movable relative to the platform 108 (the cover 104 slides up and down on the platform 108). The cover 104 includes cover sides 130 that contact at least two of the platform sides 122 (either directly or using guides 116). The sides 130 of the cover 104 move in a parallel direction to the platform sides 122 as the cover 104 moves relative to the platform 108.

The cover 104 has one or more cross-members 106 connected between opposing cover sides 130. The cross-members 106 can be formed to have a low friction surface (using, for example, polytetrafluoroethylene (PTFE) any other well-known low-friction material) or can include freely rotating rolls (which are sometimes referred to herein as rollers) mounted on roll guides 118 that help locate the rolls.

Figure 2:
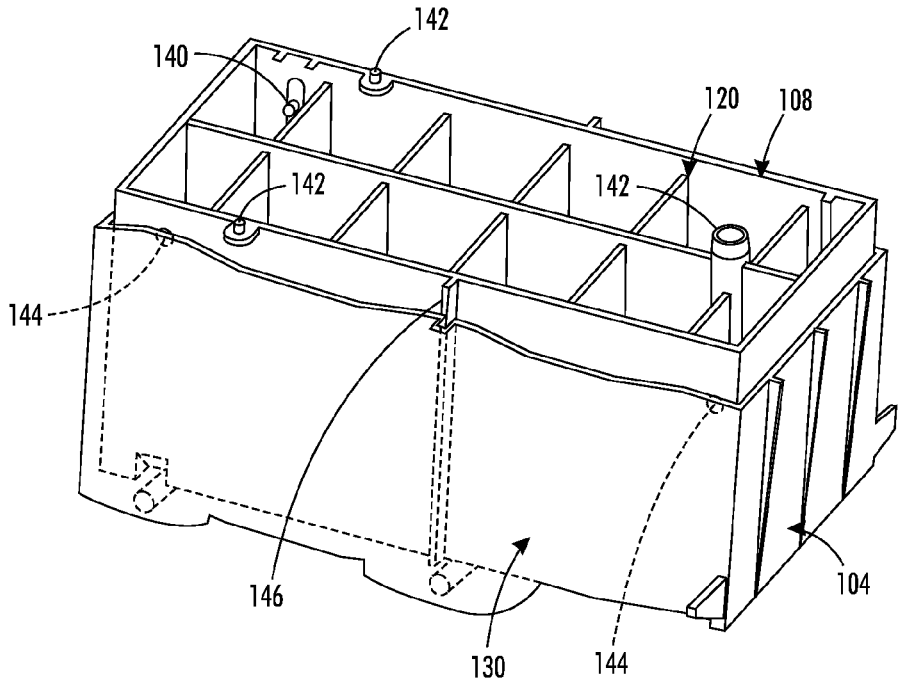
FIG. 2 is a perspective schematic diagram of a device according to embodiments herein.

As shown in FIGS. 1 and 2, various guides 116 can be used to keep the platform 108 and cover 104 aligned. Therefore, as shown in FIG. 2, the platform sides 122 can include platform side recesses 144 (sometimes referred to as holes) and/or platform side projections 146 (ribs) and are referred to herein as platform guides. Similarly, the cover sides 130 can include cover side recesses 116 and/or cover side projections (and are referred to herein as cover guides). The platform guides contact the cover guides in order to restrict movement of the cover 104 to a single path within the parallel movement direction between the platform 108 and cover sides 130.

Figure 3:
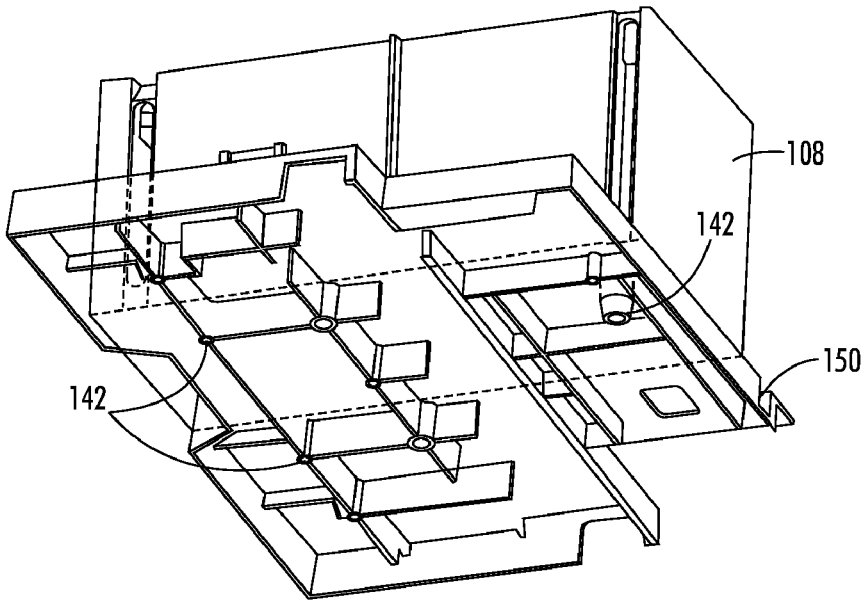
FIG. 3 is a perspective schematic diagram of a device according to embodiments herein.

As shown in inverted perspective view in FIG. 2 and bottom perspective view in FIG. 3, the platform bottom 120 can include connectors 142 that connect to a media tray 150 of a printing machine. In this example, the main body 108 has three mounting bosses 142 to locate the main body 108 on the lift bed 150 of the printer.

Figure 4:
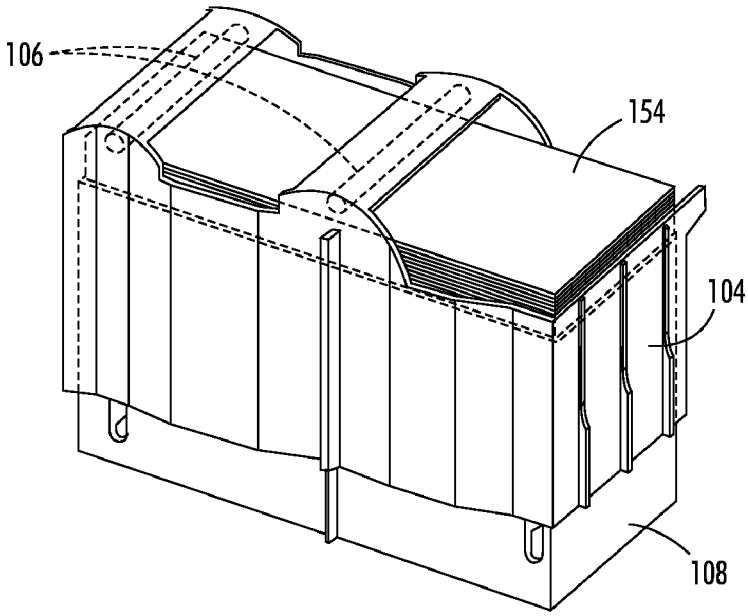
FIG. 4 is a perspective schematic diagram of a device according to embodiments herein.

In the same movement as the cover 130 sliding movement, the cross-members rollers 106 move in a perpendicular direction to the flat surface of the platform top 124 (as the cover 104 moves up and down relative to the platform 108). The cross-members rollers 106 contact and press down on the top sheet of the sheets of media 154 when the sheets of media 154 are on the flat surface of the platform top 124 (FIG. 4). (For clarity, the "top" sheet is the sheet of media 154 that is positioned farthest away from the flat surface of the platform top 124, while the bottom sheet is at the opposite end of the stack of sheets of media 154 and the bottom sheet contacts the flat surface of the platform top 124). The cross-members/rollers 106 ensure that the top surface of the envelope stack 154 is flat and minimize any drag force on the feed rollers 164 while they are engaged to feed the media (envelopes).

Figure 5:
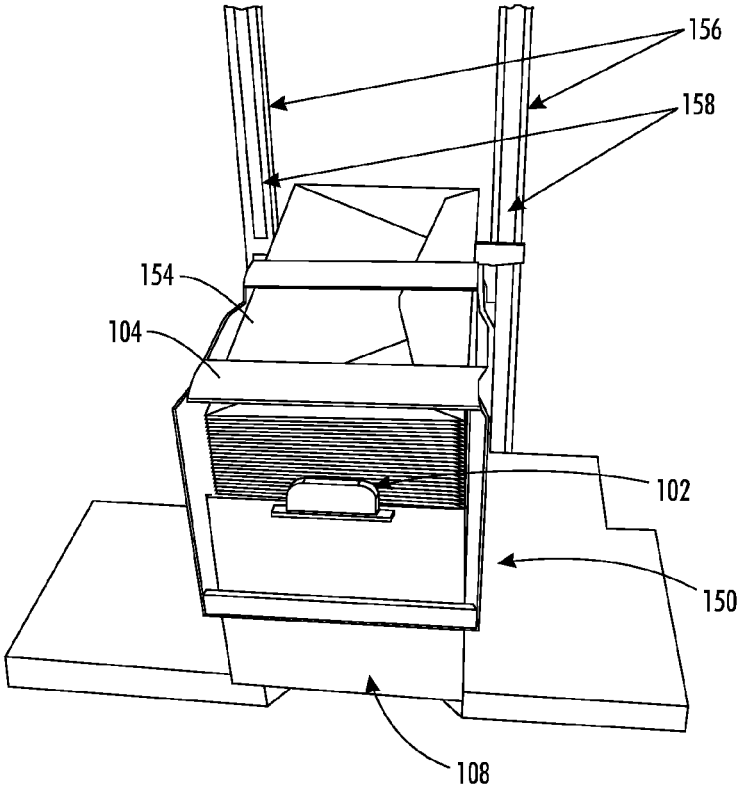
FIG. 5 is a perspective schematic diagram of a device according to embodiments herein.

As shown in FIGS. 3 and 5, the platform 108 can be mounted on the lift bed 150 (aligned with the alignment bosses 142). The slider 104 can be lifted up to install the media (e.g., folded sheets, envelopes, etc.) or the media 154 can be installed underneath the cross-members/rollers 106. The media stack 154 is generally pushed forward until the media stack 154 reaches the leading edge of the slider 104. Then, the slider 104 can be released so that the slider 104 rests on the top surface of envelope stack 154. The platform 108 is lifted by the lift bed 150 until the top surface of the envelope stack 154 hits a stack height sensor and contacts the nudger roll 160.

Figure 6:
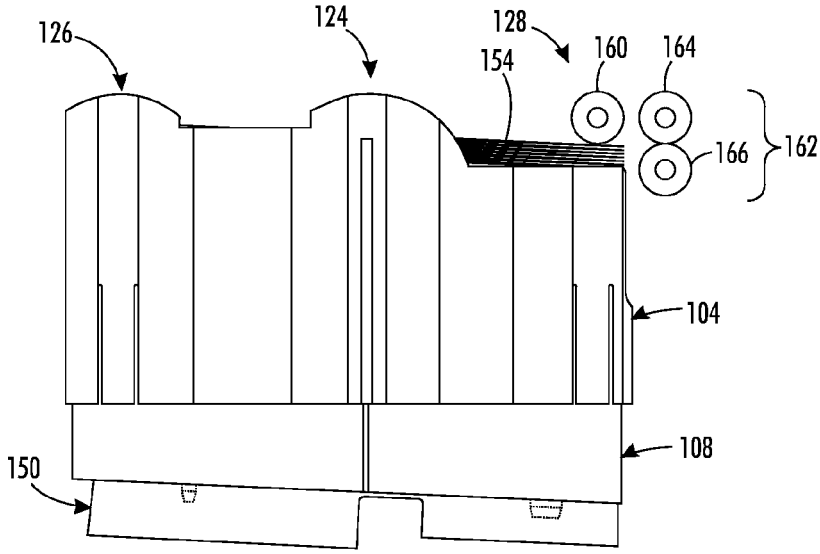
FIG. 6 is a side-view schematic diagram of a device according to embodiments herein.

As shown in FIG. 6, once the top surface of the envelope stack 154 reaches the nudger roll 160, the feed mechanism 162 starts to pick up the top envelope of the stack 154 and feeds it into the printing machine. After several envelopes are fed, and a stack height sensor turns off, the lift bed 150 will rise until it again reaches the pickup position. This routine will be continued until the envelope stack 154 is empty. If no envelope is detected by the envelope sensor, the lift bed 150 will lower the platform 108 so that the next job of envelopes can be loaded.

As shown in FIG. 5, the embodiments herein can also include additional rail guides 158 that ensure that the platform 108 follows the rails 156 of lift bed 150 until the top stack surface has reached the PFP feed mechanism. Such guides 156, 158 ensure that the platform 120 follows the rails of the paper feed system until the top of the stack 154 has reached the feed mechanism 162.

Figure 7:
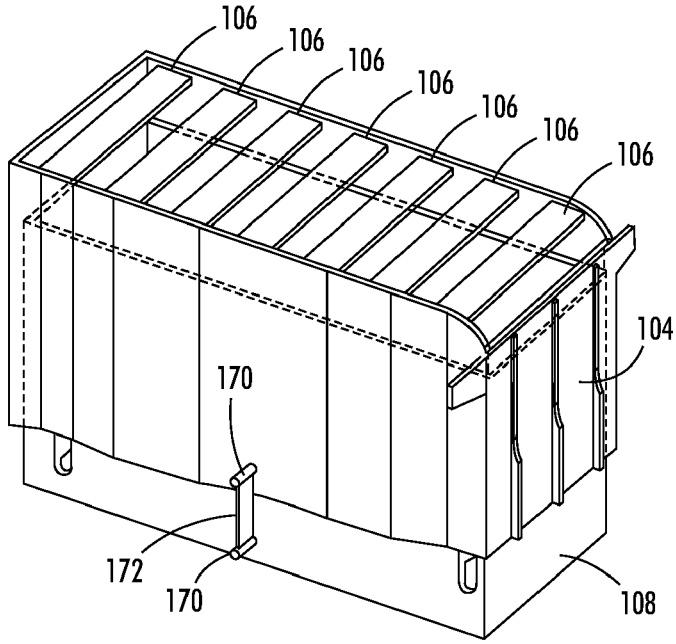
FIG. 7 is a perspective schematic diagram of a device according to embodiments herein.

As mentioned above, the envelope stack is much flatter under the weight of rolls 106 of the slider 104 because the rollers apply pressure to the sheets of media 154 in the perpendicular direction (toward the flat surface of the platform top 124) in order to reduce or eliminate the tilt that the stack of sheets of media 154 may have. This pressure can be created by the weight of the cover 104 or a biased connector 172 (spring, elastic band, biased piston, etc.) can be connected to the platform 108 and to the cover 104 through attachment projections 170 to provide additional downward bias of the cross-members/rollers 106 (FIG. 7). The biased connector 172 can draw the rollers toward the platform top 124 more than gravity alone. Thus, the rollers rotate the top sheet of the sheets of media 154 toward a position parallel to the flat surface of the platform top 124.

Further, the sides of the cover 104 align the sheets of media 154 to keep the stack of media straight. Additionally, the stopper projection 102 can extend from the distal end of the flat surface of the platform top 124. The stopper projection 102 further aligns the sheets of media 154 positioned on the flat surface of the platform top 124 to keep the stack of media sheets straight. Because the stopper 102 is located at the rear, top side of main body 108, the stopper 102 pushes the media (e.g., stacked envelopes) up against the front side of the slider 104, so that the leading edge of the envelopes will be aligned with the leading surface of the slider 104.

In the example shown in FIG. 1, one of the rollers is positioned adjacent a first distal end 126 of the flat surface of the platform top 124 and a second roller is positioned adjacent the middle of the platform top 124 (arrow 124 represents the approximate middle of the platform top). The proximate end of the platform top 124 is identified by reference numeral 128 because it is located closer to the feed rollers of the printing machine than is the distal end 126. More specifically, FIG. 6 illustrates some common pick up rollers 162 which include a nudger roll 160, seed roll 164, and retard roll 166.

The top sheet of media 154 is removed from the platform top 124 by the printing machine at a second proximate end 128 (again, the middle of the platform top 124 is located between the first end 126 and the second end 128, and the second proximate end 128 of the platform 108 is next to (proximate to) the feed rollers 162 of the printer).

Figure 8:
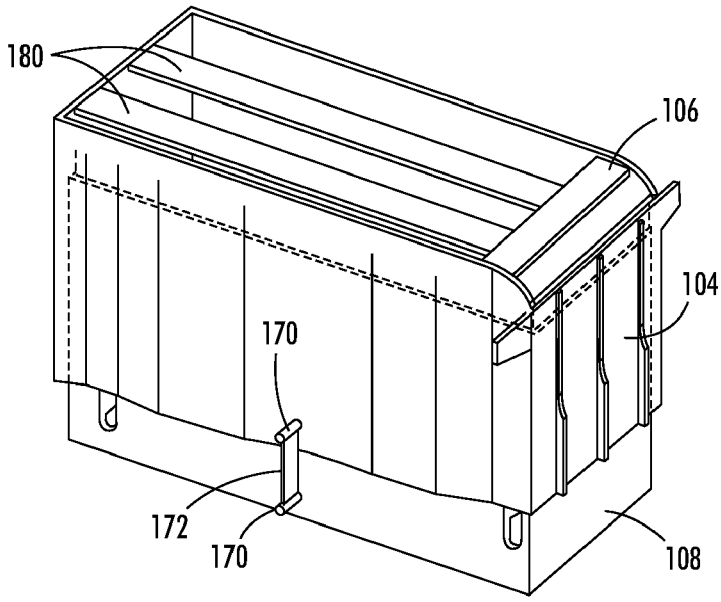
FIG. 8 is a perspective schematic diagram of a device according to embodiments herein.

In the example shown in FIG. 1, there are two rollers/cross-members 106 that are parallel to one another and are positioned adjacent the platform top 124. The center roll provides flatness of the middle of the stack, and the tail roll also presses down the tail end of stack in the envelopes. However, as would be understood by those ordinarily skilled in the art there could be a single roller/cross-member 106 or there could be many more rollers/cross-members 106, as illustrated in FIG. 7. In addition, as illustrated in FIG. 8, embodiments herein could also include longitudinal members 108 that also have a low friction surface or other devices such as roller bearings. While a limited number of such configurations are illustrated and described herein, those ordinarily skilled in the art would understand that many other configurations are possible, and all such structures are intended to be included in the claimed structure.

Figure 9:
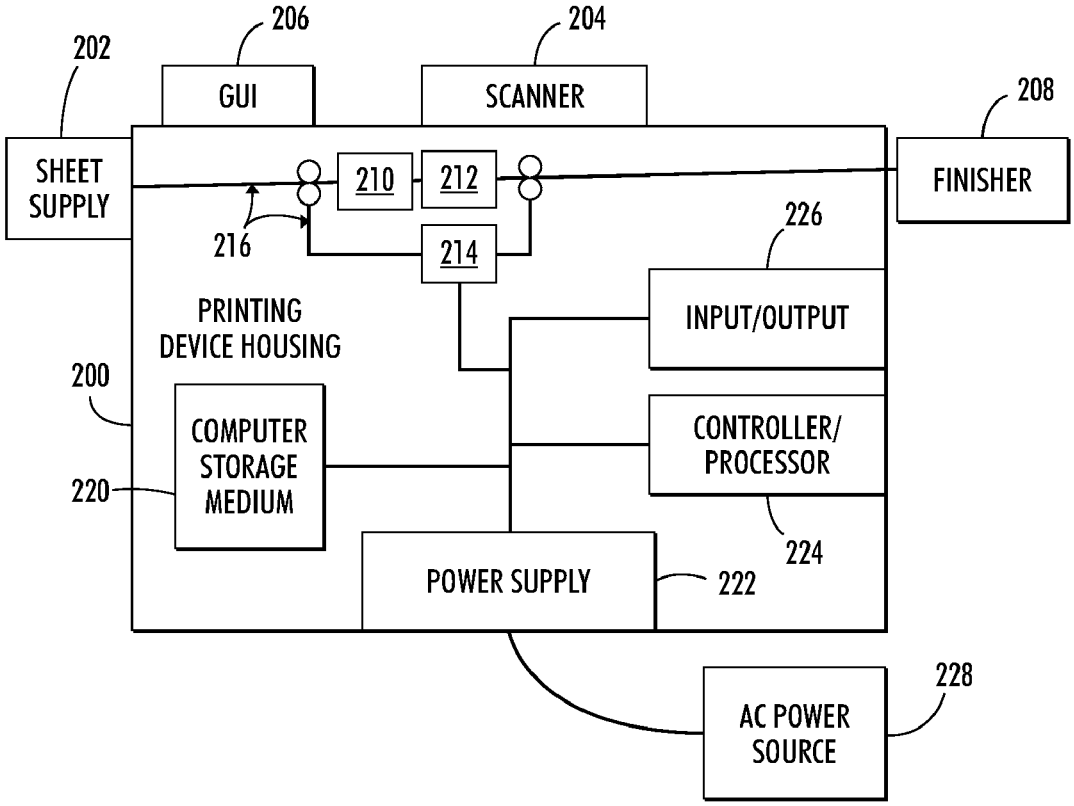
FIG. 9 is a schematic diagram of a printing device according to embodiments herein.

FIG. 9 illustrates a computerized printing device 200, which can be used with embodiments herein and can comprise, for example, a printer, copier, multi-function machine, etc. The sheet supply 202 in FIG. 9 includes the components shown in FIGS. 1-8, discussed above. The printing device 200 includes a controller/processor 224, at least one marking device (printing engines) 210, 212, 214 operatively connected to the processor 224, a media path 216 positioned to supply sheets of media from the sheet supply 202 to the marking device(s) 210, 212, 214, and a communications port (input/output) 226 operatively connected to the processor 224 and to a computerized network external to the printing device. After receiving various markings from the printing engine(s), the sheets of media can optionally pass to a finisher 208 which can fold, staple, sort, etc., the various printed sheets.

Also, the printing device 200 can include at least one accessory functional component (such as a scanner/document handler 204, sheet supply 202, finisher 208, etc.) and graphic user interface assembly 206 that also operate on the power supplied from the external power source 228 (through the power supply 222).

The input/output device 226 is used for communications to and from the multi-function printing device 200. The processor 224 controls the various actions of the printing device. A non-transitory computer storage medium device 220 (which can be optical, magnetic, capacitor based, etc.) is readable by the processor 224 and stores instructions that the processor 224 executes to allow the multi-function printing device to perform its various functions, such as those described herein.

Thus, a printer body housing 200 has one or more functional components that operate on power supplied from the alternating current (AC) 228 by the power supply 222. The power supply 222 connects to an external alternating current power source 228 and converts the external power into the type of power needed by the various components.

As would be understood by those ordinarily skilled in the art, the printing device 200 shown in FIG. 9 is only one example and the embodiments herein are equally applicable to other types of printing devices that may include fewer components or more components. For example, while a limited number of printing engines and paper paths are illustrated in FIG. 9, those ordinarily skilled in the art would understand that many more paper paths and additional printing engines could be included within any printing device used with embodiments herein.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. An envelope feed apparatus comprising:

a main body having a main body bottom, a main body top located opposite said main body bottom, and main body sides located between said main body bottom and said main body top, said main body top having a flat surface that supports a stack of envelopes; and a slider including slider sides contacting at least two of said main body sides, said slider being movable relative to said main body, said slider sides moving in a parallel direction to said main body sides as said slider moves relative to said main body, said slider comprising at least one roller connected to opposing ones of said slider sides, said roller being positioned adjacent said main body top, said roller moving in a perpendicular direction to said flat surface of said main body top as said slider moves relative to said main body, said roller contacting said stack of envelopes when said stack of envelopes is on said flat surface of said main body top, said roller applying pressure to said stack of envelopes in said perpendicular direction toward said flat surface of said main body top, said slider sides aligning said stack of envelopes positioned on said flat surface of said main body top, said at least two main body sides including main body side guides, and said main body side guides restricting movement of said slider to a single path within said parallel direction.

2. The apparatus according to claim 1, further comprising an envelope stopper projection extending from said flat surface of said main body top, said envelope stopper projection aligning said stack of envelopes positioned on said flat surface of said main body top.

3. The apparatus according to claim 1, said slider sides including slider guides, said main body side guides contacting said slider guides, and said main body side guides and said slider guides restricting movement of said slider to said single path within said parallel direction.

4. An envelope feed apparatus comprising:

a main body having a main body bottom, a main body top located opposite said main body bottom, and main body sides located between said main body bottom and said main body top, said main body top having a flat surface that supports a stack of envelopes; and a slider including slider sides contacting at least two of said main body sides, said slider being movable relative to said main body, said slider sides moving in a parallel direction to said main body sides as said slider moves relative to said main body, said slider comprising at least one roller connected to opposing ones of said slider sides, said roller being positioned adjacent said main body top, said roller moving in a perpendicular direction to said flat surface of said main body top as said slider moves relative to said main body, said roller contacting said stack of envelopes when said stack of envelopes is on said flat surface of said main body top, said roller applying pressure to said stack of envelopes in said perpendicular direction toward said flat surface of said main body top, said slider sides aligning said stack of envelopes positioned on said flat surface of said main body top, and said slider sides having a shape to provide an envelope exit, said stack of envelopes passing through said envelope exit as envelopes are individually removed from a top of said stack of envelopes.

5. An envelope feed apparatus comprising:

a main body having a main body bottom, a main body top located opposite said main body bottom, and main body sides located between said main body bottom and said main body top, said main body top having a flat surface that supports a stack of envelopes; and a slider including slider sides contacting at least two of said main body sides, said slider being movable relative to said main body, said slider sides moving in a parallel direction to said main body sides as said slider moves relative to said main body, said slider comprising at least one roller connected to opposing ones of said slider sides, said roller being positioned adjacent said main body top, said roller moving in a perpendicular direction to said flat surface of said main body top as said slider moves relative to said main body, said roller contacting said stack of envelopes when said stack of envelopes is on said flat surface of said main body top, said roller applying pressure to said stack of envelopes in said perpendicular direction toward said flat surface of said main body top, said slider sides aligning said stack of envelopes positioned on said flat surface of said main body top, and said apparatus further comprising a spring connected to said main body and to said slider, said spring drawing said cross member toward said main body top.

6. An apparatus comprising:

a platform having a platform bottom, a platform top located opposite said platform bottom, and platform sides located between said platform bottom and said platform top, said platform top having a flat surface that supports sheets of media; and a cover including cover sides contacting at least two of said platform sides, said cover being movable relative to said platform, said cover sides moving in a parallel direction to said platform sides as said cover moves relative to said platform, said cover comprising at least one cross-member connected to opposing ones of said cover sides, said cross-member being positioned adjacent said platform top, said cross-member moving in a perpendicular direction to said flat surface of said platform top as said cover moves relative to said platform, said cross-member contacting said sheets of media when said sheets of media are on said flat surface of said platform top, said cross-member applying pressure to said sheets of media in said perpendicular direction toward said flat surface of said platform top, said cover sides aligning said sheets of media positioned on said flat surface of said platform top, said at least two platform sides including at least one of platform side recesses and platform side projections, said cover sides including at least one of cover side recesses and cover side projections, said at least one of platform side recesses and platform side projections contacting said at least one of cover side recesses and cover side projections, and said at least one of platform side recesses and platform side projections and said at least one of cover side recesses and cover side projections restricting movement of said cover to said single path within said parallel direction.

7. The apparatus according to claim 6, further comprising a projection extending from said flat surface of said platform top, said projection aligning said sheets of media positioned on said flat surface of said platform top.

8. An apparatus comprising:

a platform having a platform bottom, a platform top located opposite said platform bottom, and platform sides located between said platform bottom and said platform top, said platform top having a flat surface that supports sheets of media; and a cover including cover sides contacting at least two of said platform sides, said cover being movable relative to said platform, said cover sides moving in a parallel direction to said platform sides as said cover moves relative to said platform, said cover comprising at least one cross-member connected to opposing ones of said cover sides, said cross-member being positioned adjacent said platform top, said cross-member moving in a perpendicular direction to said flat surface of said platform top as said cover moves relative to said platform, said cross-member contacting said sheets of media when said sheets of media are on said flat surface of said platform top, said cross-member applying pressure to said sheets of media in said perpendicular direction toward said flat surface of said platform top, said cover sides aligning said sheets of media positioned on said flat surface of said platform top, and said cover sides having a shape to provide a sheet exit, said sheets of media passing through said sheet exit as said sheets of media are individually removed from a top of said sheets of media.

9. An apparatus comprising:

a platform having a platform bottom, a platform top located opposite said platform bottom, and platform sides located between said platform bottom and said platform top, said platform top having a flat surface that supports sheets of media; and a cover including cover sides contacting at least two of said platform sides, said cover being movable relative to said platform, said cover sides moving in a parallel direction to said platform sides as said cover moves relative to said platform, said cover comprising at least one cross-member connected to opposing ones of said cover sides, said cross-member being positioned adjacent said platform top, said cross-member moving in a perpendicular direction to said flat surface of said platform top as said cover moves relative to said platform, said cross-member contacting said sheets of media when said sheets of media are on said flat surface of said platform top, said cross-member applying pressure to said sheets of media in said perpendicular direction toward said flat surface of said platform top, and said cover sides aligning said sheets of media positioned on said flat surface of said platform top, said apparatus further comprising a biased connector connected to said platform and to said cover, said biased connector drawing said cross member toward said platform top.

10. An apparatus comprising:

a platform having a platform bottom, a platform top located opposite said platform bottom, and platform sides located between said platform bottom and said platform top, said platform top having a flat surface that supports sheets of media; and a cover including cover sides contacting at least two of said platform sides, said cover being movable relative to said platform, said cover sides moving in a parallel direction to said platform sides as said cover moves relative to said platform, said cover comprising at least two rollers connected to opposing ones of said cover sides, said rollers being parallel to one another and being positioned adjacent said platform top, said rollers moving in a perpendicular direction to said flat surface of said platform top as said cover moves relative to said platform, said rollers contacting a top sheet of said sheets of media when said sheets of media are on said flat surface of said platform top, said top sheet comprising one of said sheets of media that is positioned farthest away from said flat surface of said platform top, said rollers applying pressure to said sheets of media in said perpendicular direction toward said flat surface of said platform top, and said cover sides aligning said sheets of media positioned on said flat surface of said platform top.

11. The apparatus according to claim 10, further comprising a projection extending from said flat surface of said platform top, said projection aligning said sheets of media positioned on said flat surface of said platform top.

12. The apparatus according to claim 10, said at least two platform sides including at least one of platform side recesses and platform side projections, said cover sides including at least one of cover side recesses and cover side projections, said at least one of platform side recesses and platform side projections contacting said at least one of cover side recesses and cover side projections, and said at least one of platform side recesses and platform side projections and said at least one of cover side recesses and cover side projections restricting movement of said cover to a single path within said parallel direction.

13. The apparatus according to claim 10, said cover sides having a shape to provide a sheet exit, said sheets of media passing through said sheet exit as said sheets of media are individually removed from a top of said sheets of media.

14. The apparatus according to claim 10, further comprising a biased connector connected to said platform and to said cover, said biased connector drawing said rollers toward said platform top.

15. An apparatus comprising:

a platform having a platform bottom, a platform top located opposite said platform bottom, and platform sides located between said platform bottom and said platform top, said platform top having a flat surface that supports sheets of media; and a cover including cover sides contacting at least two of said platform sides, said platform bottom comprising connectors that connect to a media tray of a printing machine, said cover being movable relative to said platform, said cover sides moving in a parallel direction to said platform sides as said cover moves relative to said platform, said cover comprising at least two rollers connected to opposing ones of said cover sides, said rollers being parallel to one another and being positioned adjacent said platform top, said rollers moving in a perpendicular direction to said flat surface of said platform top as said cover moves relative to said platform, said rollers contacting a top sheet of said sheets of media when said sheets of media are on said flat surface of said platform top, said top sheet comprising one of said sheets of media that is positioned farthest away from said flat surface of said platform top, said rollers applying pressure to said sheets of media in said perpendicular direction toward said flat surface of said platform top to rotate a top sheet of said sheets of media toward a position parallel to said flat surface of said platform top, said cover sides aligning said sheets of media positioned on said flat surface of said platform top, a first roller of said rollers being positioned adjacent a first end of said platform top, a second roller of said rollers being positioned adjacent a middle of said platform top, said top sheet being removed from said platform top by said printing machine at a second end of said platform top and, said middle of said platform top being located between said first end and said second end.

16. The apparatus according to claim 15, further comprising a projection extending from said flat surface of said platform top, said projection aligning said sheets of media positioned on said flat surface of said platform top.

17. The apparatus according to claim 15, said at least two platform sides including at least one of platform side recesses and platform side projections, said cover sides including at least one of cover side recesses and cover side projections, said at least one of platform side recesses and platform side projections contacting said at least one of cover side recesses and cover side projections, and said at least one of platform side recesses and platform side projections and said at least one of cover side recesses and cover side projections restricting movement of said cover to a single path within said parallel direction.

18. The apparatus according to claim 15, said cover sides having a shape to provide a sheet exit, said sheets of media passing through said sheet exit as said top sheet is removed from said sheets of media by said printing machine.

19. The apparatus according to claim 15, further comprising a biased connector connected to said platform and to said cover, said biased connector drawing said rollers toward said platform top.

* * * * *